US006463855B2

(12) United States Patent
Zehnder et al.

(10) Patent No.: US 6,463,855 B2
(45) Date of Patent: Oct. 15, 2002

(54) FUSE DEVICE FOR A MORTAR SHELL

(75) Inventors: Wolfgang Zehnder, Schramberg; Günter Westphal, Hardt; Wolfgang Schillinger, Schiltach; Frank Kienzler, Villingen-Schwenningen; Herbert Höni, Aichalden-Röthenberg; Horst Moosmann, Schramberg, all of (DE)

(73) Assignee: Junghans Feinwerktechnik GmbH & Co. KG, Schramberg (DE)

( * ) Notice: Subject to any disclaimer, the term of this patent is extended or adjusted under 35 U.S.C. 154(b) by 0 days.

(21) Appl. No.: 09/754,208

(22) Filed: Jan. 5, 2001

(65) Prior Publication Data

US 2001/0017090 A1 Aug. 30, 2001

(30) Foreign Application Priority Data

Jan. 5, 2000 (DE) ..... 100 00 177

(51) Int. Cl.[7] ..... F42C 11/02
(52) U.S. Cl. ..... 102/223; 102/252; 102/221
(58) Field of Search ..... 102/221, 223, 102/230, 234, 235, 251, 254, 256, 253, 244

(56) References Cited

U.S. PATENT DOCUMENTS

| | | | | | |
|---|---|---|---|---|---|
| 772,470 | A | | 10/1904 | Meigs et al. | |
| 2,999,461 | A | * | 9/1961 | Apotheloz et al. | 102/253 |
| 3,140,661 | A | | 7/1964 | Clarke | |
| 3,552,318 | A | | 1/1971 | Briggs | |
| 3,677,185 | A | | 7/1972 | Reams | |
| 3,677,186 | A | | 7/1972 | Munach | |
| 3,777,666 | A | * | 12/1973 | Morel | 102/234 |
| 3,842,743 | A | | 10/1974 | Zittle | |
| 3,901,156 | A | * | 8/1975 | Rognmo et al. | 102/254 |
| 4,128,061 | A | * | 12/1978 | Kaiser | 102/251 |
| 4,419,934 | A | * | 12/1983 | Apotheloz | 102/235 |
| 4,449,457 | A | * | 5/1984 | Halssig | 102/244 |
| 4,464,991 | A | * | 8/1984 | Kaiser | 102/235 |
| 4,677,914 | A | * | 7/1987 | Apotheloz | 102/233 |
| 4,679,503 | A | | 7/1987 | Rüdenauer et al. | |
| 4,726,294 | A | * | 2/1988 | Apotheloz et al. | 102/221 |
| 4,876,960 | A | * | 10/1989 | Schillinger et al. | 102/251 |
| 5,016,532 | A | * | 5/1991 | Edminster | 102/221 |
| 5,063,847 | A | * | 11/1991 | Halssig et al. | 102/256 |
| 5,269,223 | A | * | 12/1993 | Mattsson et al. | 102/230 |
| 5,576,510 | A | * | 11/1996 | Rudenauer | 102/223 |
| 5,714,709 | A | * | 2/1998 | Schillinger et al. | 102/255 |

FOREIGN PATENT DOCUMENTS

| | | | | |
|---|---|---|---|---|
| DE | 31 26 288 | | 5/1983 | |
| DE | 4112960 | A1 * | 10/1992 | 102/221 |
| EP | 0 162 335 | | 11/1985 | |
| EP | 0 709 646 | | 5/1996 | |
| FR | 340 346 | | 7/1904 | |
| GB | 15 796 | | 2/1907 | |

* cited by examiner

*Primary Examiner*—Michael J. Carone
*Assistant Examiner*—Lulit Semunegus
(74) *Attorney, Agent, or Firm*—Burns, Doane, Swecker & Mathis, LLP

(57) ABSTRACT

A fuse device for a mortar shell includes an impact weight carrying a detonation charge and arranged to impact against a firing pin when the mortar shell strikes a target. A safety arm locks the impact weight against movement toward the firing pin in a safety position. The safety arm is movable out of locking relationship with the impact arm to establish an armed condition of the fuse device. Energy for moving the safety arm is stored in a spring. That energy is stored after the mortar shell has been launched, because an impeller is rotated by an air flow generated by the moving mortar shell, and that impeller rotation is transmitted to the spring to store energy.

10 Claims, 6 Drawing Sheets

FUSE DEVICE FOR A MORTAR SHELL

This application claims priority under 35 U.S.C. §119 and/or 365 to German Patent Application Serial No. 100 00 177.7 filed in Germany on Jan. 5, 2000; the entire content of which is hereby incorporated by reference.

BACKGROUND OF THE INVENTION

The invention relates to a fuse device, in particular for a mortar shell.

Known mortar shells use fuse devices having a spring device which is fitted into the respective fuse device in a mechanically pre-stressed or pre-biased condition. Those known fuse devices are set from the safe position into the armed or live position by means of the pre-biased spring device. The mechanical energy which is stored in the mechanically biased spring device in the safe position adversely influences the safety of the fuse device.

In consideration of those factors, the object of the present invention is to provide such a fuse device in which preferably no mechanical energy (or only a relatively small amount of mechanical energy) is stored in the spring device in the safe position, so that the safety properties in the safe position of the fuse device are substantially improved.

SUMMARY OF THE INVENTION

In accordance with the invention, a fuse device for a mortar shell includes a safety element movable from a safety position to an armed position, a spring for producing such movement, and a spring-stressing mechanism for storing energy in the spring to produce the movement. The spring-stressing mechanism comprises an impeller arranged in an air flow path and rotated by an air flow generated in the flow path in response to travel of the mortar shell toward a target. The impeller is operably connected to the spring for stressing the spring in response to being rotated by the air flow.

The fuse device according to the invention has the advantage that no (or very little) mechanical energy tending to arm the device is pre-stored in the spring device in the safe position of the fuse device so that the safety properties are at an optimum. The mechanical biasing of the spring device which is necessary to set the fuse device from the safe position into the armed position is effected only after leaving the barrel from which the mortar shell is launched, by means of the impeller, by virtue of a suitable operative connection of the impeller to the spring device, which spring device can be in the form of a coil torsion spring.

BRIEF DESCRIPTION OF THE DRAWINGS

Further details, features and advantages will be apparent from the description hereinafter of an embodiment by way of example illustrated in the drawing of the fuse device according to the invention for a mortar shell which is shown in section. In the drawing.

DETAILED DESCRIPTION OF A PREFERRED

Embodiment of the Invention

Figure 6:
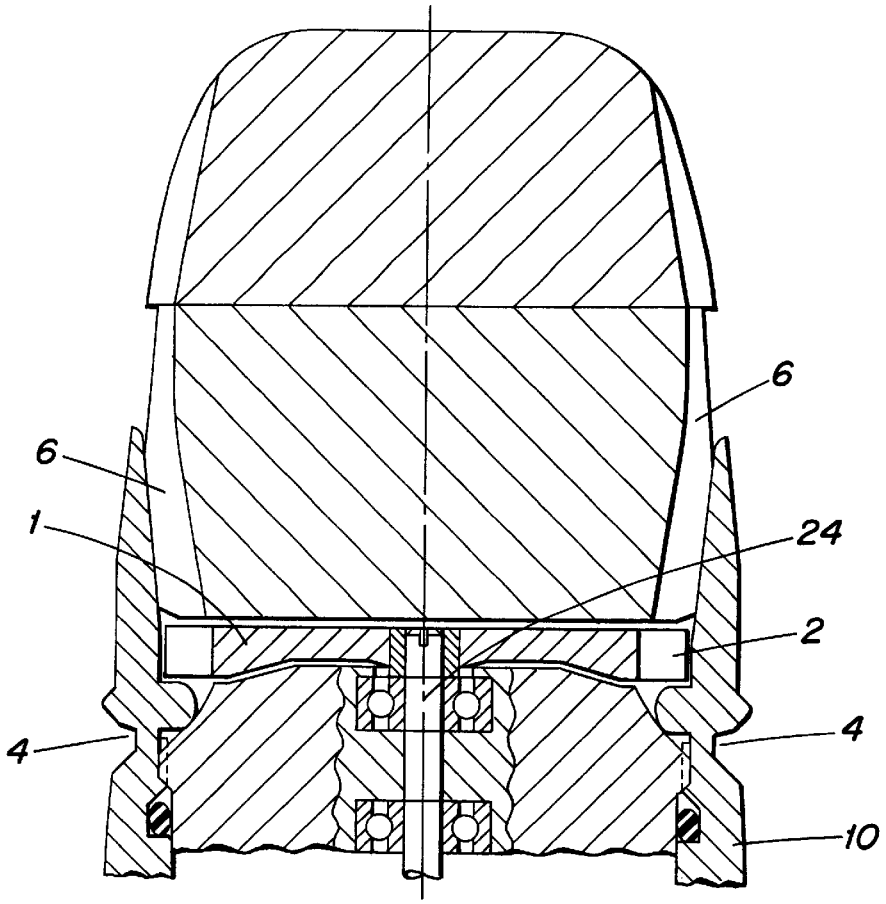
FIG. 6 is a view in longitudinal section through a front portion of the fuse device.

Descripted below is a preferred embodiment of a fuse device for a mortar shell, wherein a spring employed to transform the fuse device into an armed state is not pre-stressed prior to launching of the mortar shell, but rather becomes stressed after launch by the action of a rotary impeller 1 (FIG. 6) that is rotated by the action of an air flow generated by the motion of the launched mortar shell. That rotation is transmitted to the spring by a rotation transmitting mechanism, or arming drive (described in detail below), in order to wind up the spring and store energy therein.

Figure 1:
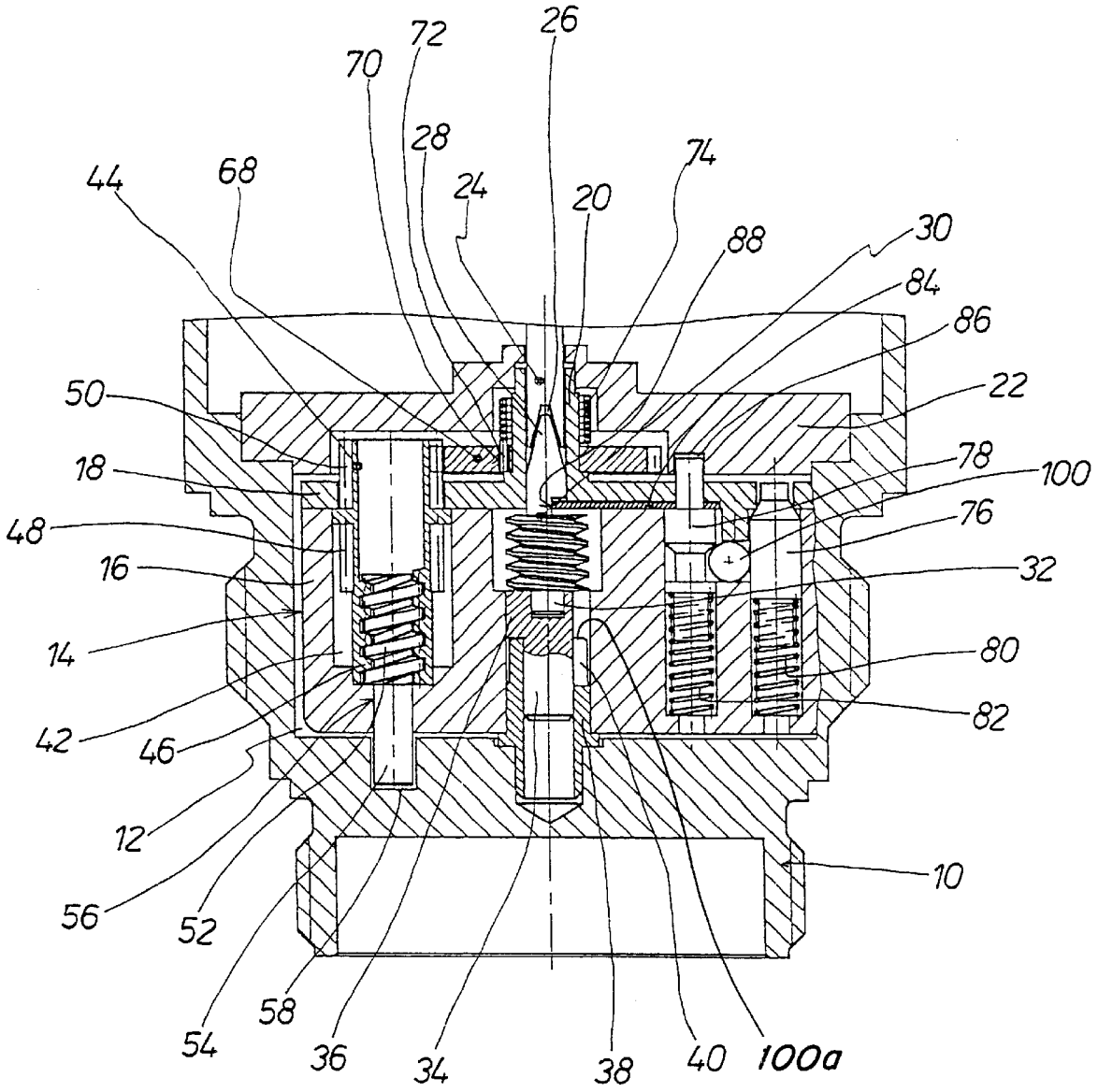
FIG. 1 is a view in longitudinal section through a rear portion of a fuse device according to the invention, in a safety position.

FIG. 1 shows a rear end portion of a mortar shell having an outer casing 10 which forms a receiving space 12 for a fuse device 14. The fuse device 14 includes a safety device housing 16 fixed to a plate 18 having a central sleeve 20. The central sleeve 20 of the plate 18 and a cover 22 which closes the receiving space 12 serve to support a shaft 24 whose front end is connected to a rotary impeller 1 (see FIG. 6). The shaft 24 is provided at its rear end remote from the impeller with a wedge-shaped slot 26 into which a corresponding wedge-shaped coupling portion 28 of a worm 30, projects in positively locking (i.e., drive-transmitting) relationship, in the safe position of the fuse device, whereby rotation of the impeller is transmitted to the worm 30.

The worm 30 includes a mounting trunnion 32, located remotely from the wedge-shaped coupling portion 28, and seated for rotation in a blind hole formed in an entrainment member 34. The worm 30 is a self-locking worm capable of rotating in only one direction. The entrainment member 34, formed with a radially outwardly projecting nose 36, is rotationally supported in a fixed sleeve 38 provided with a slot 40. The nose 36 of the entrainment member 34 rests against a front surface 100 of the sleeve 38 in the safety position of the fuse device (see FIG. 1) to keep the coupling portion 28 of the worm disposed within the slot 26 of the shaft 24. But, the nose 36 becomes disposed in the slot 40 in the sleeve 38 to uncouple the worm from the shaft 24 in the armed position of the fuse device 14, as will be explained. That is, the entrainment member is connected to the housing 16 so as to be rotatable therewith (when the housing 16 rotates to establish an armed condition of the fuse device), but the entrainment member is capable of moving axially relative to the housing 16 when the nose 36 becomes aligned with the slot 40.

The impeller 1 includes outer blade tips 2 that are disposed in an air flow path 4*a*, 4*b* formed in the casing 10. Once the mortar shell has been launched, an air flow travels through the flow path and causes the impeller to rotate; that rotation is transmitted to a spring 74, by a mechanism to be described, to stress the spring 74.

A toothed sleeve 44 of the arming drive is rotatably supported in a mounting space 42 of the housing 16. The toothed sleeve 44 has a female screwthread portion 46 and two external gear rings 48 and 50. A screwthread portion 52 of an arming shaft 54 is screwed into the female screwthread portion 46. The arming shaft 54 extends, in a condition of being prevented from rotating, through a through hole 56 in the housing 16 and terminates within a blind hole 58 of the casing 10 to prevent the housing 16 from rotating relative to the casing 10.

Figure 2:
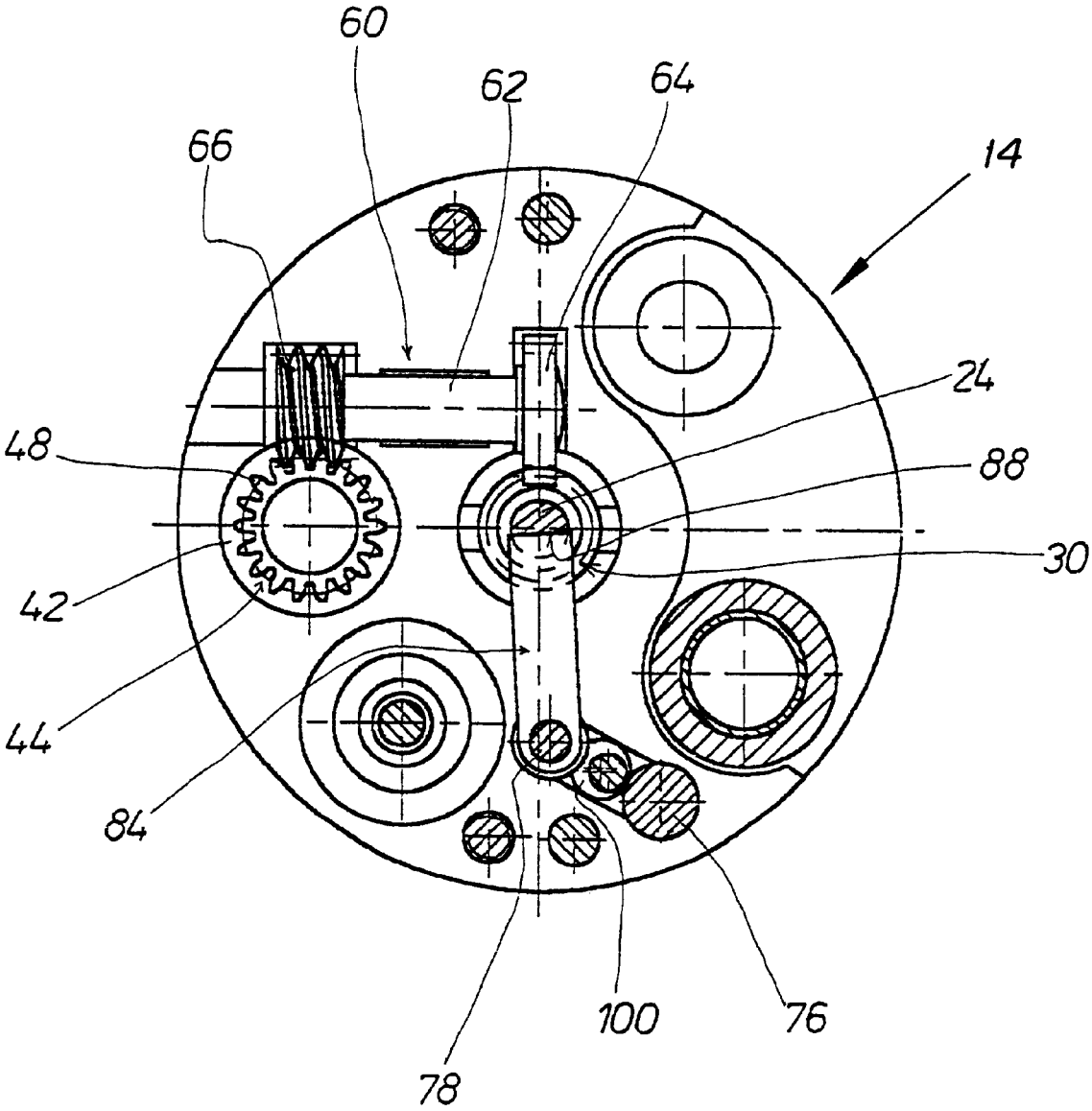
FIG. 2 is a view in cross-section through the fuse device.
Figure 3:
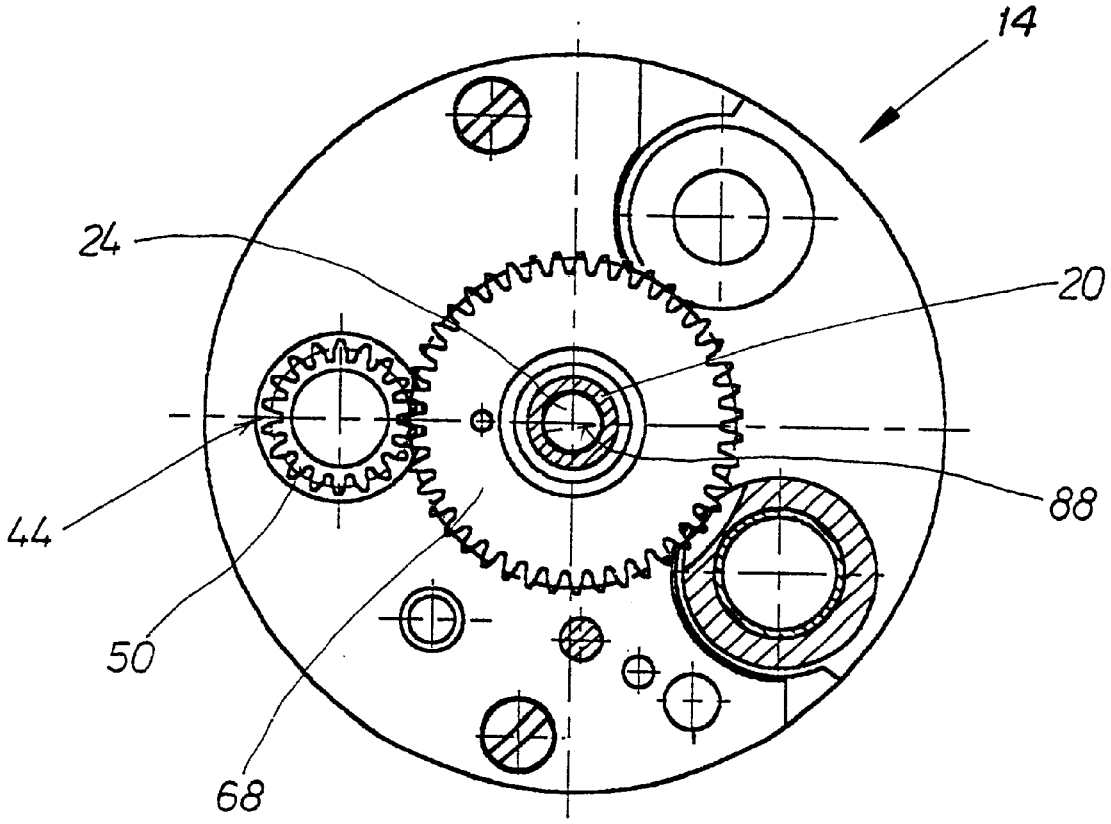
FIG. 3 is another view in cross-section through the fuse device, along a section plane spaced axially from that of FIG. 2.

As can be seen from FIG. 2 the worm 30 is operatively connected in torque-transmitting relationship with the external gear ring 48 of the toothed sleeve 44 of the arming drive by means of a connecting device 60. The device 60 includes a connecting shaft 62 which has at one end thereof a gear ring 64 meshing with the worm 30, and at the other end portion remote therefrom has a worm 66 meshing with the external gear ring 48 on the toothed sleeve 44.

An output drive gear 68 which is supported rotatably on the central sleeve 20 of the plate 18 (see FIG. 1), is in meshing engagement with the second external gear ring 50 of the toothed sleeve 44 of the arming drive. The output drive gear 68 is formed for example with an arcuate slot 70 which is concentric with respect to the shaft 24 and which has an arcuate opening angle of about 30 degrees. Projecting into the arcuate slot 70 is a rear end portion 72 of a spring 74 which is preferably in the form of a coil torsion spring. The front end portion of the spring device 74 is fixed to the cover 22.

A first arming pin 76 and a second arming pin 78 are axially movably mounted in the housing 16. The first arming pin 76 is urged forwardly towards the plate 18 by means of an associated coil compression spring 80 and the second arming pin 78 is similarly urged by means of an associated coil compression spring 82. The second arming pin 78 extends through a holder in the form of a safety plate member 84 disposed between the housing 16 and the plate 18 and extends through the plate 18 into a blind hole 86 in the cover 22.

The worm 30 is formed with a bevel surface 88 against which the safety plate member 84 bears in positively locking relationship in the safety position of the fuse device 14 in order to prevent rotary movement of the worm 30. The safety plate member 84 is held in that position by the arming pin 78.

Figure 7:
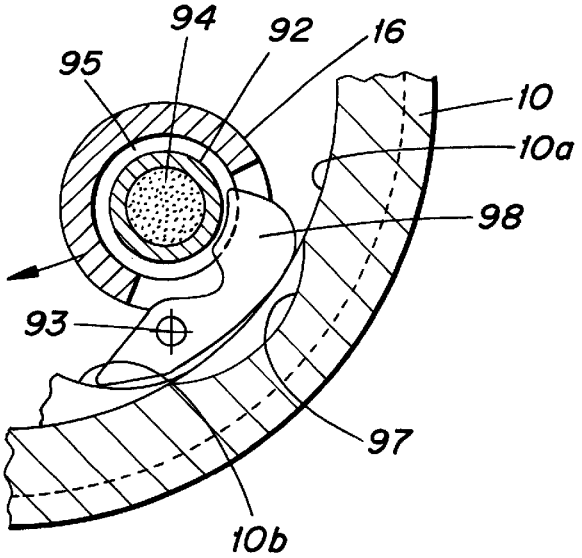
FIG. 7 is an enlarged fragmentary view taken along line VII—VII in FIG. 4 showing a safety lever in a safety position.
Figure 8:
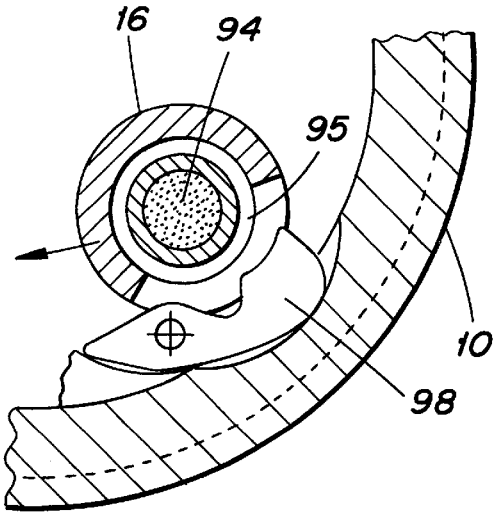
FIG. 8 is a view similar to FIG. 7 after the safety lever has been moved out of the safety position.

An impact weight 92 carrying a detonator 94 is mounted in a receiving space 90 of the housing 16 (see FIGS. 1, 7 and 8). The housing 16 carries a safety arm in the form of a safety lever 98 which is mounted for rotation about a pin 93. In the safety position of the fuse device, the safety lever is engaged within an annular slot 95 of the impact weight 92, to prevent the impact weight from moving forwardly toward a firing pin 96 that is fixed to the plate 18 in alignment with the impact weight 92. The safety lever is held within the slot 95 by a safety spring (e.g., a tension spring (not shown). In order to release the lever 98 from the impact weight, the housing 16 must be rotated. When that occurs, and the housing approaches an end of its rotary movement (i.e., in a counterclockwise direction as viewed in FIG. 7), the lever 98 becomes located next to a recess 97 formed in an inner surface 10*a* of the casing 10. As the housing 16 reaches its terminus (FIG. 8), an end of the lever 98 rides along a cam surface 10*b* fixed to the inner surface 10*a*, causing the lever 98 to be swung into the recess 97 and exit the slot 95 to release the impact weight 92 for movement toward the firing pin when the mortar shell impacts against a target.

Figure 4:
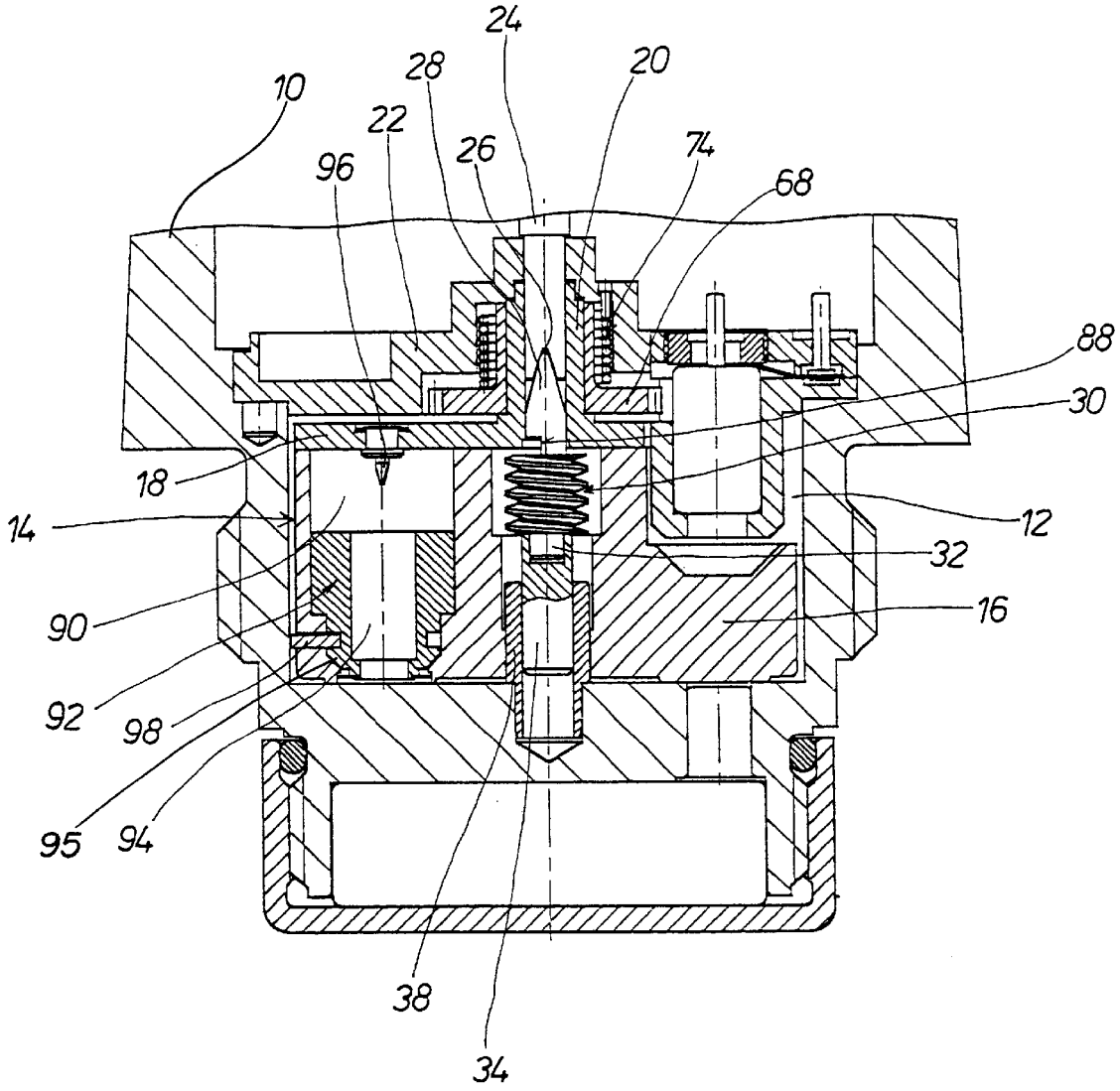
FIG. 4 is a view in longitudinal section similar to FIG. 1 to show the safe position of the fuse device.
Figure 5:
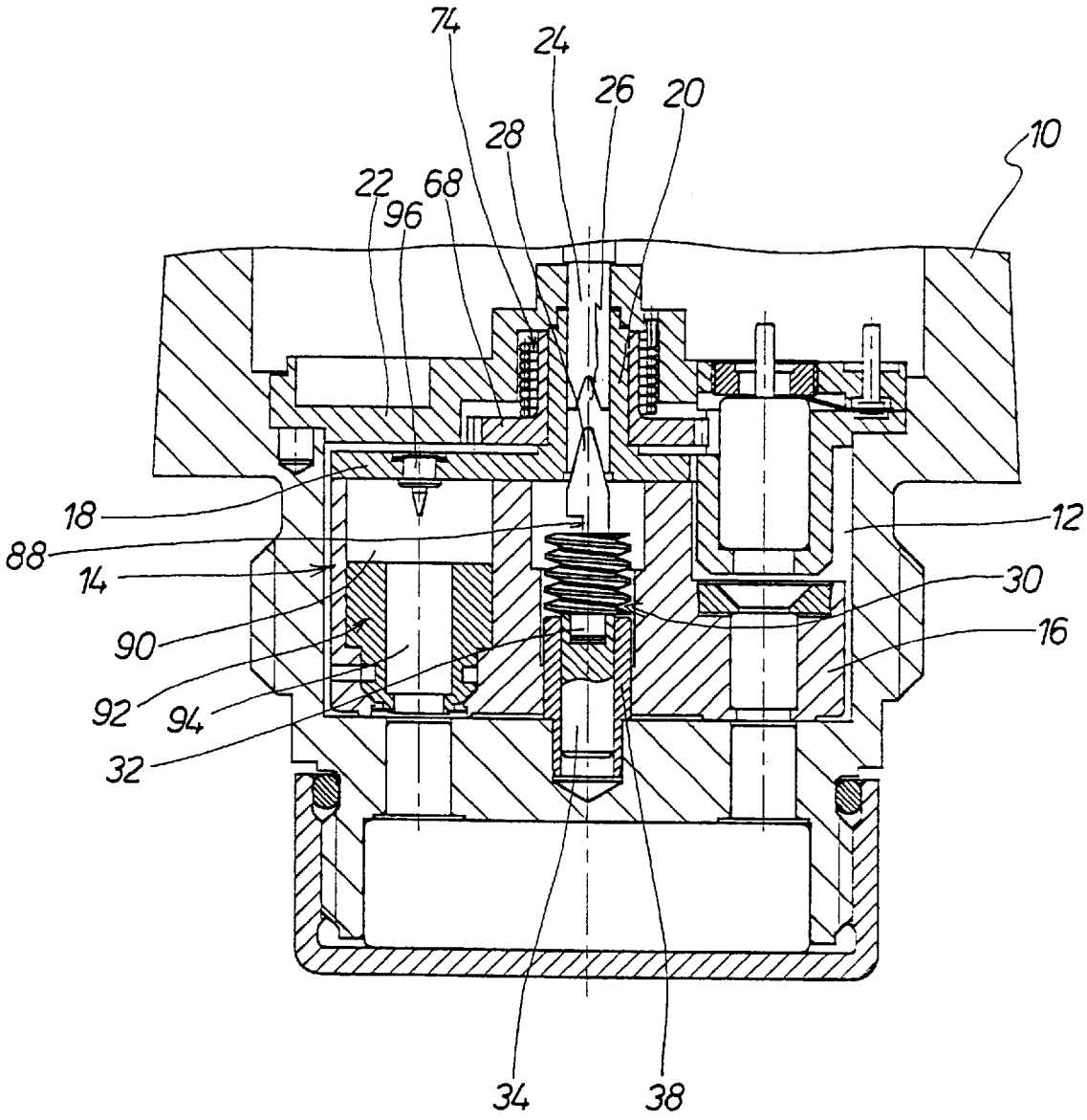
FIG. 5 is a view in longitudinal section similar to FIG. 4 to show the armed position of the fuse device.

The mode of operation of the fuse device 14 is as follows:

1) Safe Position:

In the safe position the first and second arming pins 76 and 78 and the arming shaft 54 are in the positions shown in FIG. 1. The spring device 74 is in a non-stressed condition, that is to say little or no energy is stored in the spring device 74. The safety plate member 86 is in a position wherein it blocks rotation of the shaft 24 and is held in that position by means of the second arming pin 78. In the safe position the impact weight 92 is held fast at a spacing from the firing pin 96 by means of the safety lever 98 (see FIG. 4).

2) Armed Position:

When the mortar shell is fired from a barrel, firstly the first arming pin 76, due to inertia, moves in a rearward direction to compress the associated coil compression spring 80 so that the ball 100 between the first and second arming pins 76 and 78 can move towards the right in FIG. 1. That releases the second arming pin 78, subsequently to the releasing of the first arming pin 76, enabling the pin 78 to move under inertia in a rearward direction to compress its associated coil compression spring 82. When that happens, the second arming pin 78 moves out of the blind hole 86 in the cover 22 and out of the plate 18 and out of the safety plate member 84 and thereby releases the safety plate member 84.

That means that the shaft 24 and the worm 30 are no longer prevented from rotating. The shaft 24 can therefore be rotated as air impinges against the impeller 1. The worm 30 is thereby rotated by the shaft 24. As the worm 30 rotates, it drives the connecting device 60 which, in turn, rotates the gear 48 of the sleeve 44. The sleeve 44 thus rotates, causing the non-rotatable arming shaft 54 to be driven forwardly, due to the screw thread connection 52 between the arming shaft 54 and the sleeve 44. As a result, the arming shaft 54 is moved away from the hole 58. Also, as the sleeve 44 rotates, its gear 50 rotates the gear 68 to which one end of the spring 74 is connected. Since the lower end of the spring is disposed in the slot 70 of the gear 68, the gear 68 will rotate slightly, e.g., about thirty degrees before that spring end begins to rotate with the gear 68. Since the opposite end of the spring 74 is fixed to the cover 22, the spring will be tightened and stressed as the gear 68 rotates. By way of example, the impeller 1 performs about 600 revolutions, during which the spring device 74 is mechanically stressed. Eventually, the arming shaft 54 is moved out of the hole 58, thereby rendering the housing 16 rotatable.

The now fully wound spring 74 exerts a rotary counter force against the gear 50 via the gear 68, but since the gear 50 cannot rotate reversely, the spring force causes the housing to rotate in a direction to cam the lever 98 out of locking relationship with the impact weight 92 (see FIG. 8). The housing 16 is rotated by the spring 74 until the housing engages a fixed stop surface (not shown) to prevent further rotation.

The rotation of the housing 16 also produces rotation of the entrainment member 34 for an angular distance sufficient to bring the nose 36 into alignment with the slot 40. Now there is no force for keeping the coupling portion 28 of the worm within the slot 26 of the shaft 24. The worm thus walks downwardly (axially) along the gear 64, whereupon the nose 36 enters the slot 40, and the worm moves out of driven relationship with the shaft 24, so that the shaft 24 can rotate freely. In the armed condition the entrainment member 34 arrests the safety device housing 16.

The arcuate slot 70 in the output drive gear 68 serves to ensure an improved start-up performance on the part of the fan wheel shaft 24 because the spring device 74 is only mechanically stressed after the output drive gear 68 has rotated for example through about 30 degrees of angle.

It is possible for the spring 74 to be pre-stressed in a manner applying a pre-bias tending to rotate the housing in a direction for keeping the lever 98 in locking relationship with the impact weight 92 (i.e., in a clockwise direction as viewed in FIG. 7). Thus, once the housing is released for rotation, its initial rotation will serve to eliminate such prebias. In that case the end portion 72 of the spring device 74 can be fixed to the output drive gear 68. The start-up performance can also be improved as desired by such a slight mechanical biasing effect in the opposite direction of rotation- in that case however, as in known fuse devices, the spring device would be mechanically biased, even if only relatively slightly.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A fuse device for a mortar shell including:

a safety element movable-from a safety position to an armed position;

a spring for producing such movement;

a spring-stressing mechanism for storing energy in the spring to produce the movement, the spring-stressing mechanism comprising an impeller arranged in an air flow path to be rotated by an air flow generated in response to travel of the mortal shell toward a target, the impeller operably connected to the spring for stressing the spring in response to being rotated by the air flow;

a rotation transmission mechanism actuable for transmitting rotation from the impeller to the spring to stress the spring; and a holder for holding the rotation transmission mechanism against actuation and for releasing the rotation transmission mechanism for actuation in response to firing of the mortar shell, the holder comprising a safety plate held by arming pins in a position for preventing actuation of the rotation transmission mechanism, the arming pins arranged to release the safety plate in response to rearward inertia produced by firing of the mortar shell.

2. The fuse device according to claim 1 further including an impact weight carrying a detonation charge in alignment with a firing pin, the safety element comprising an arm movable out of locking relationship with the impact weight.

3. A mortar shell comprising:

an impeller mounted to be rotated by an air flow generated in response to movement of the mortar shell upon being launched;

a safety arm movable between a safety position and an arming position;

a coil torsion spring having a fixed end and a movable end;

a spring-stressing mechanism having a drive input end connected to the impeller and a drive output end connected to the movable end of the spring for storing energy in the spring in response to rotation of the impeller;

a safety arm moving mechanism connected between the spring and the safety arm to move the safety arm to its arming position in response to a release of energy from the spring;

a firing pin; and an impact weight carrying a detonation charged and being arranged to be released for movement toward the firing pin when the safety arm is moved from its safety position to its arming position.

4. A fuse device for a mortar shell comprising:

an outer casing;

a firing pin disposed within the outer casing;

an impact weight carrying a detonation charge and arranged within the outer casing to impact against the firing pin in response to a launched mortar shell impacting against a target;

a housing disposed in the casing for rotation;

a safety arm mounted on the housing and arranged in a safety position for preventing the impact weight from moving into impacting relationship with the firing pin, the safety arm being movable to a release position in response to rotation of the housing permitting such movement of the impact weight;

an arming shaft-arranged for movement between a first position preventing rotation of the housing, and a second position releasing the housing for rotation;

a shaft-moving mechanism actuable for moving the arming shaft from the first position to the second position;

actuating mechanism for actuating the shaft-moving mechanism comprising:

an impeller mounted on the casing to be rotated by an air flow generated in response to travel of the mortar shell toward the target, a rotation transmission mechanism for transmitting rotation of the impeller to the shaft-moving mechanism for actuating the shaft-moving mechanism, a safety pin arrangement for preventing the rotation transmission mechanism from actuating the shaft-moving mechanism until the mortar shell has been launched and for enabling the rotation transmission mechanism to actuate the shaft-moving mechanism in response to launching of the mortar shell, and a spring arranged to store energy in response to the transmission of rotation from the impeller to the shaft-moving mechanism, and for releasing the stored energy to rotate the housing in response to a releasing of the housing for rotation.

5. The fuse device according to claim 4 wherein the rotation transmission mechanism comprises a worm operably connected to the impeller to be rotated thereby, a gear connected to the arming shaft for displacing the arming shaft in response to rotation of the gear, and a drive arrangement for transmitting rotation from the worm to the gear.

6. The fuse device according to claim 5 wherein the gear comprises a first gear; there being a second gear connected to the first gear for movement therewith; a third gear arranged to be rotated by the second gear; the spring comprising a coil torsion spring including a first end connected to the third gear to be rotated thereby, and a second end anchored against rotation.

7. The fuse device according to claim 6 wherein the third gear includes a slot, the first end of the spring disposed in the slot, wherein stressing of the spring is delayed until the third gear rotates by a predetermined angle.

8. The fuse device according to claim 6 wherein the worm and the third gear are coaxial with respect to an axis of rotation of the impeller.

9. The fuse device according to claim 8 wherein the first and second gears are rotatable about a common axis arranged parallel to the axis of rotation.

10. The fuse device according to claim 5 wherein the impeller is fixed to a rotary drive shaft arranged to rotate the worm, the worm being axially movable away from the drive shaft to break a drive connection therewith in response to rotation of the housing by a predetermined angle.

* * * * *